United States Patent [19]

Stouffer

[11] 4,398,664

[45] Aug. 16, 1983

[54] FLUID OSCILLATOR DEVICE AND METHOD

[75] Inventor: Ronald D. Stouffer, Silver Spring, Md.

[73] Assignee: Bowles Fluidic Corporation, Silver Spring, Md.

[21] Appl. No.: 248,144

[22] Filed: Mar. 30, 1981

Related U.S. Application Data

[63] Continuation-in-part of Ser. No. 952,910, Oct. 19, 1978, and Ser. No. 845,117, Oct. 25, 1977, Pat. No. 4,151,955.

[51] Int. Cl.[3] ..... B05B 1/08; F15B 21/12

[52] U.S. Cl. ..... 239/11; 137/811; 137/833; 239/590

[58] Field of Search ..... 239/11, 101, 102, 390, 239/589, 590, 590.5, DIG. 3; 137/808–811, 815, 822, 823, 833, 835–839

[56] References Cited

U.S. PATENT DOCUMENTS

| | | | |
|---|---|---|---|
| 3,080,886 | 3/1963 | Severson | 137/815 |
| 3,209,774 | 10/1965 | Manion | 137/811 |
| 3,247,860 | 4/1966 | Zilberfarb | 137/833 |
| 3,432,102 | 3/1969 | Turner et al. | 239/DIG. 3 |
| 3,452,772 | 7/1969 | Zaloudek | 137/809 |
| 3,998,386 | 12/1976 | Viets et al. | 239/102 |
| 4,052,002 | 10/1977 | Stouffer et al. | 239/102 X |

*Primary Examiner*—Johnny D. Cherry
*Attorney, Agent, or Firm*—Jim Zegeer

[57] ABSTRACT

A pair of liquid flow passages are formed in a chamber and liquid flow through the passages is alternately blocked and unblocked by alternately pulsating vortices which causes alternate pulsations of fluid flow through the pairs of liquid flow passages.

2 Claims, 6 Drawing Figures

FIG. 1a
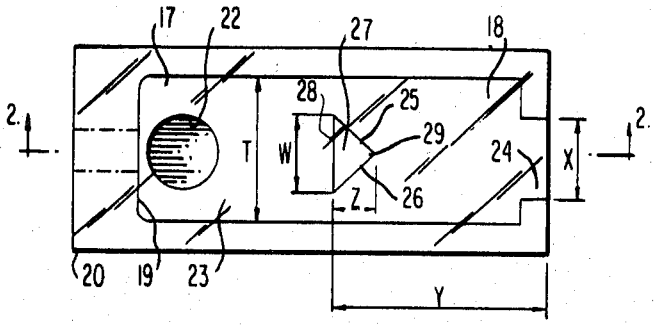
FIG. 1b
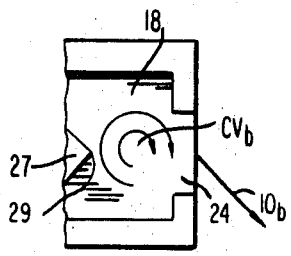
FIG. 1c
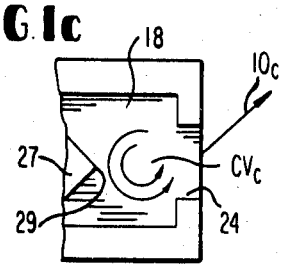
FIG. 2
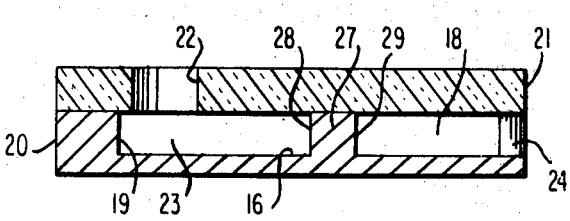
FIG. 3
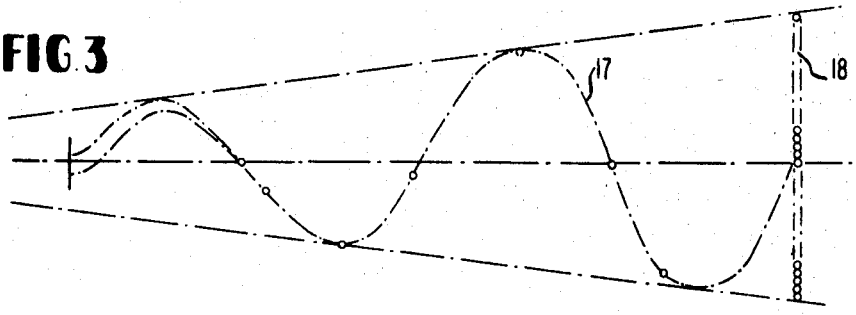
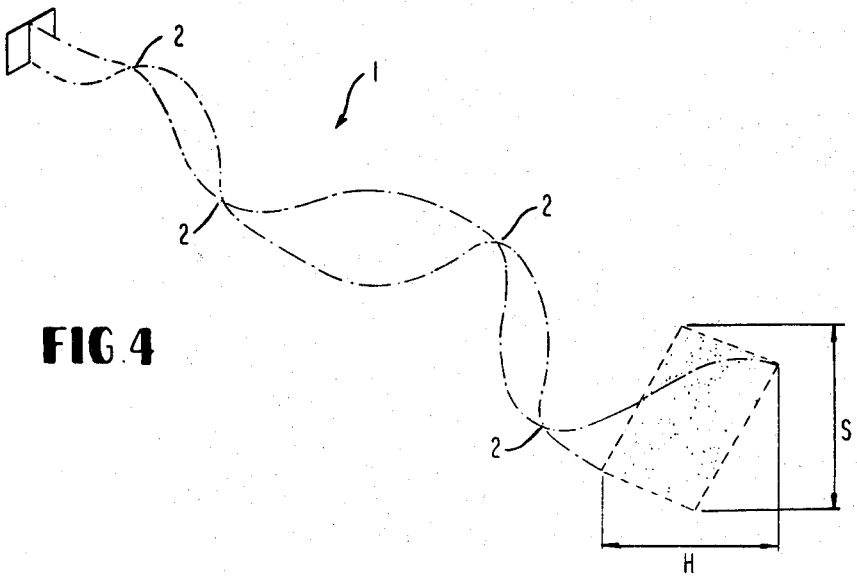
FIG. 4

FLUID OSCILLATOR DEVICE AND METHOD

DESCRIPTION

Reference to Related Applications

This application is a continuation-in-part of my application Ser. No. 952,910 filed Oct. 19, 1978 and of my application Ser. No. 845,117 filed Oct. 25, 1977 now U.S. Pat. No. 4,151,955, both assigned to the assignee hereof and the priority benefit of those applications and U.S. Pat. No. 4,151,955 is claimed herein under 35 USC 120. This application also claims the benefit of my application Ser. No. 960,195 filed Nov. 13, 1978 under 35 USC 120.

BACKGROUND OF THE INVENTION

The present invention relates to fluid dispersal devices or the like, and, more particularly, to such a device of simple and inexpensive construction which requires relatively low fluid pressures to establish various meaningful spray patterns.

Until recently, in order to achieve spray patterns of different desired configurations, one merely shaped an orifice accordingly. Thus, a jet flow could be achieved from a simple small round aperture; a sheet flow could be achieved from a linear aperture; swirl nozzles could be used to effect conical spray patterns etc. This nozzle shaping approach is simple and inexpensive but the resulting nozzles generally require relatively high applied fluid pressures in order to produce useful spray patterns.

A considerable advance in fluid dispersal devices is described in Stouffer et al Patent 4,052,002 wherein a low pressure (on the order of 0.1 psi) fluidic oscillator is disclosed which issues a transversely oscillating fluid jet which, because of the oscillation, distributes itself in a fan shape pattern residing in a plane. The interaction of a liquid jet with ambient air results in the jet breaking up in droplets of uniform size and distribution along the fan width. Other approaches to fluid dispersal nozzles are disclosed in U.S. Pat. No. 3,638,866 (Walker), U.S. Pat. No. 3,423,026 (Carpenter) and U.S. Pat. No. 3,911,858 (Goodwin).

Objects of the Invention

The object of this invention is to provide a fluid jet or sheet which is oscillated to produce a fan-like pattern in the dispersal of fluids.

BRIEF DESCRIPTION OF THE DRAWINGS

The above and other objects, advantages, and features of the invention will become more apparent when considered with the following detailed description taken with the accompanying drawings wherein:

FIG. 1A is a plan view of a preferred embodiment of the invention employing the oscillator principle of my above-identified application, FIG. 1B and FIG. 1C are partial sectional views of the nozzle useful in explaining the operation of the invention;

FIG. 2 is a cross-sectional view taken along lines 2—2 of FIG. 1A;

FIG. 3 is a diagrammatic representation of a typical waveform of the flow pattern issued from the outlet end of the present invention which operates in the swept jet mode; and, FIG. 4 is a diagrammatic representation of a typical waveform of the flow issued from the preferred embodiment of the invention which operates in the swept sheet mode.

DESCRIPTION OF THE PREFERRED EMBODIMENT

Referring specifically to FIG. 1A, and keeping in mind that the basic objective of this invention is to provide a jet or sheet which is oscillated to produce a swept pattern for fluid dispersal, two plates 20 and 21 made, for example, of plastic material, of generally rectangular configuration, although given solely by way of example and is not intended to be limiting. Top plate 21 is shown as being a clear plastic and, therefore, transparent, so as to facilitate an understanding of the structure and operation of the invention. Top plate 21 and bottom plate 20 are bonded together along their bottom and top surfaces, respectively, by adhesive, clamping by screws or the like and in fact can be integrally formed. An inlet hole 22 for fluid is provided through top plate 21 although such inlet may be provided through plate 20 or directly in the wall 19 opposite of obstruction 27. A generally rectangular recess is defined in the top surface of bottom plate 20, the recess being sealed by top plate 21 to form chamber 23 into which input fluid may flow through inlet hole 22 at one chamber end 17. Chamber 23 has an outlet opening 24 defined in the plane of the recess at the other chamber end 18. The outlet 24 is defined between two opposed edges which are usually spaced by a distance less than the chamber width so that the outlet 24 is effectively a flow restrictor. Flow restricting outlet 24 isolates the chamber from ambient pressure under normal operating conditions.

As disclosed in my above-identified application U.S. Ser. No. 845,117 now U.S. Pat. No. 4,151,955 (which is incorporated herein in its entirety by reference) an obstruction or obstacle 27 in the form of an upstanding island from the floor 16 of chamber 23, is positioned between the inlet hole 22 and outlet 24. Obstruction or island 27, as shown, is triangular with one side facing upstream and normal to the flow direction of fluid from inlet 22 to outlet 24. The other two sides 25 and 26 meet at an apex 29 which points generally towards outlet 24. This triangular configuration is not the only one which can be used for the island or obstruction in accordance with the principles of this invention. For example, the obstruction may be circular, elliptical, rectangular, polygonal, a flat plate, etc. However, a preferred embodiment utilizes the triangular configuration since it appears to provide the best results.

In accordance with this invention when the flow impinges upon the blunt upstream facing surface of obstacle 27, due to some random perturbation, slightly more liquid flow will pass to one side (e.g. the top side in FIG. 1) than the other. The increased flow past the top side creates a vortex just downstream of the upstream facing flow impingement surface 28. The vortex tends to backload or block flow around the top side so that more flow tends to pass around the bottom side thereby reducing the strength of the top side vortex but initiating a bottom side vortex. When the bottom side vortex is of sufficient size it backloads or blocks liquid flow about that side to redirect most of the flow past the top side to restart the cycle.

The space downstream of apex end 29 to the outlet end 24 or region constitutes a vortex chamber and is designed to facilitate the establishment of vortices, as described above, in the wake of island 29, and, as disclosed in my above application, the vortex is a vortex street and is designed to facilitate the merging of the split portion of the stream fairly within the device to assure the sweeping or fanning action of the fluid issuing from outlet 24. The triangular configuration when presenting a flat surface to the flow, has a high drag coefficient. In addition, the tapering of the converging sides 25 and 26 presents a suitable region for the cavitation effect which tends to facilitate the vortex formation. The cavitation effect, as described above aids in drawing the pulsating split portions of the stream back together. Such an effect could be achieved by gradually sloping the side walls towards the outlet opening 24.

In operation, fluid under pressure is admitted into chamber 23 via inlet 22. If the applied fluid pressure is sufficiently high (and this required pressure may be only one psi or less, depending on the size of the oscillator) the fluid fills chamber 23 and a flow stream is established between inlet 22 and outlet 24. Restricted outlet 24 serves to isolate the chamber 23 from ambient air so that ambient air cannot interfere with formation of the vortices in the vortex street. As the flow passes obstruction 27 a vortex street is established between the obstruction and outlet 24. The vortex street causes the flow issuing from the outlet to sweep back and forth in the plane of FIG. 1A, providing either a pattern 17 of the type illustrated in FIG. 3, or a pattern 1 of the type illustrated in FIG. 4. Which pattern is produced depends to a large extent on the geometry of the device. This can be illustrated by referring to the dimensions shown in FIG. 1A wherein: W is the length of upstream-facing side 28 of the island 27; T is the width of chamber 23; X is the width of outlet 24; Y is the distance between side 28 and outlet 24; and Z is the downstream length of island 27. The following discussion assumes that W=0.412 inch; T=1.009 inches, or 2.45 W; Z=0.200 inch or 0.485 W; and the depth of the recesses in plate 20 is 0.125 inch, or 0.303 W. The unit of FIG. 1A was tested by varying X for Y=2.0 inches, or 4,85 W; for Y=1.33 inches, or 3.23 W; and for Y=0.42 inch, or 1.02 W. The unit was operated with water, at a nominal pressure of 1 to 2 psi, spraying into air.

For Y=4.58 W, the device produced a sweeping jet pattern (pattern 17 of FIG. 3) for all values of X between X=0.9 to X=T−2.45 W. For values of X below 0.9 W a non-sweeping jet was issued. It was also observed that the angle of the swept jet (i.e., the fan angle) varied from 33° at X=0.9 W to approximately 75° at X≧1.9 W in a curve similar to a logarmithmic curve which assymetrically approached 75° at X −1.9 W and beyond.

For Y=3.23 W, the device produced a swept sheet pattern (pattern 1 of FIG. 4) for all values of X between X≈0.6 W and X=T=2.45 W. For values of X immediately below approximately 0.6 W a jet, swept over a narrow angle, was observed; the jet seemed to increase in thickness (dimension H of FIG. 4) until a discernible sheet appears at approximately X=0.6 W. Between X=0.6 W and X≈2.0 W the sweep angle (corresponding to dimension S in FIG. 4) increased with X, substantially linearly at first and then with a decreasing slope. A sweep angle of approximately 25° was noted at X=0.6 W and an angle of approximately 80° was noted at X=2.0 W. Between X=2.0 W and X−T=2.45 W the fan angle decreases from approximately 80° to 60° with negatively increasing slope. The angle of the sheet (i.e., the angle in the plane normal to the sweep angle and corresponding to dimension H in FIG. 4) also changes with X. Specifically, this angle increases from 20° at X=0.7 W to approximately 60° at X=1.7 W, and then decreases to about 35° at X=T=2.45 W.

For Y=1.02 W, sweeping was found to occur only in the range from X=1.65 W to X=1.82 W. In that range, the fan angle varied from approximately 25° to approximately 90°; the sheet angle remained constant at 120°. For values of X below 1.65 W a non-sweeping sheet was observed which increased in angle with increasing X. For values of X above 1.82 the cavitation region was observed to extend outside the device so that two pulsating jets, which eventually merged downstream of the device, were issued.

Referring now to FIGS. 1B and 1C, the output region or chamber 18 of FIG. 1A is shown as being relatively short and sustaining an output control vortex $CV_b$ in FIG. 1B and $CV_c$ in FIG. 1C. As described above, the shed vortices produce first and second fluid pulse trains at opposite sides of the base 28 of island 27 and thus, these produce first and second fluidic signals of varying amplitude and different phases. These incoming fluid pulse trains are converted into the output control vortices $CV_b$ and $CV_c$ at a point just beyond the apex end 29 of island 27. In FIG. 1B, the control vortex $CV_b$ is illustrated as rotating in a counter clockwise direction with the direction of the fluid stream being indicated by the arrow 10*c*. The establishment of these control vortices $CV_b$ and $CV_c$ in output chamber or section 18 thus provides the cyclically sweeping spray pattern illustrated in FIGS. 3 and 4. As described earlier herein, whether the sweeping pattern is a swept jet (FIG. 3) or a sheet sweeping (FIG. 4) is controlled and determined by the geometry as described earlier.

From the test results described in the immediately foregoing paragraphs, it was concluded that:

(1) as the distance of the island 27 from outlet 24 (dimension Y) increases, the tendency toward a sweeping jet mode increases;

(2) as distance Y decreases, the tendency toward a sweeping sheet mode increases;

(3) as the width of outlet 24 (dimension X) increases, the sweep angle tends to increase.

In separate tests it has also been observed that as the depth of the unit, particularly in the region of outlet 24, increases, the tendency toward a sweeping sheet mode increases. In still other tests it has been observed that increases in applied pressure have a tendency to favor a swept sheet mode, although for sufficiently large values of Y there is no sheet formation irrespective of applied pressure. Further, it has been observed that increasing the length of side 28 (dimension W) has a tendency toward providing a swept sheet operating mode.

A typical swept jet pattern 17 is illustrated in FIG. 3. When viewed normal to the plane of oscillation, the pattern appears as a fan; the cross-section taken transverse to the flow direction appears as a line. The representation in FIG. 3 is a stop-action waveform presented for purposes of illustrating the manner in which the fluid is dispersed in a plane and may be seen with a strobascope. In actuality, the spray appears to the human eye as a fan-shape pattern full of droplets (in the case of liquid) with no discernible waveform. This is because the oscillation frequency is faster than can be perceived by the human eye (nominally, at least a few hundred hertz). When liquid is used as the working fluid, the droplets in the spray pattern, when striking a surface, wet a line 18 across that surface. If the oscillator is moved normal to the direction of flow (i.e., into the plane of the drawing) the spray pattern wets a rectangular target area having a width equal to the length of line pattern 18 leaving a pattern similar to that left by a paint roller as it moves along that wall.

The area spray 1 is illustrated in FIG. 4 and is, in essence, a sheet of water which resides in a plan normal to the oscillation plane and which is swept back and forth by the vortices that exist between the end 29 of obstruction 27 in outlet 24. The height of the sheet (i.e., the dimension normal to the oscillation plane) varies within each oscillation cycle, reaching a minimum at the two extremities up to of the sweep and a maximum midway between those extremities. The resulting pattern 3 produced on a target surface is diamond-shaped. The diamond width S is dependent upon the sweep angle or the oscillator; the diamond height H depends on the height of the sheet. For the same size oscillator and the same operating pressure, the droplets formed in the liquid spray pattern 1 of FIG. 4 are much smaller than the droplets formed from a liquid spray pattern 17 such as shown in FIG. 3. The reason for this is that the issued jet in the pattern 17 of FIG. 3 tends to remain integral as it leaves the oscillator so that the cyclical sweeping action is the primary break up or droplet inducing mechanism. In pattern 1 of FIG. 4, the out-of-plane expansion of the liquid appears to be caused by the two separated flow portions recombining by impinging upon one another approximate the outlet of the device. This impingement of itself causes an initial break up which is further enhanced by the sweeping action.

While I have described and illustrated one specific embodiment of my invention, it will be clear that variations in details of construction may be resorted to by those skilled in the art without departing from the true spirit and scope of the invention as defined in the appended claims.

I claim:

1. A liquid oscillator comprising, a chamber, liquid inlet means for introducing liquid under pressure into said chamber, liquid outlet means for forming an outlet from said chamber to ambient, means forming a pair of parallel liquid passageways in said chamber between said liquid inlet means and said liquid outlet means, means in said chamber to create alternately pulsating vortices which increase and decrease in strength, associated with said parallel liquid passageways, respectively, which alternately block and pass fluid flow through said pair of liquid passageways with the increasing and reducing strength of said vortices causing pulsating fluid flows through said passageways, respectively.

2. A method for producing alternately pulsating first and second liquid streams, each said liquid stream being of varying liquid flow rate and of different phase, respectively, comprising, providing liquid flow through a pair of parallel liquid flow passageways from a common source to a common liquid outlet, and, inducing alternately pulsating vortices for rythmically and alternately blocking and unblocking, respectively, liquid flow through said pair of liquid passageways to said common outlet.

* * * * *